United States Patent [19]

Takahashi et al.

[11] Patent Number: 4,656,441

[45] Date of Patent: Apr. 7, 1987

[54] COAXIAL LINE-TO-MICROSTRIP LINE TRANSITION DEVICE

[75] Inventors: Hiroshi Takahashi, Neyagawa; Tomoki Uwano, Hirakata; Takashi Machida, Kadoma; Hirokazu Kitamura, Ogaki, all of Japan

[73] Assignee: Matsushita Electric Industrial Co., Ltd., Osaka, Japan

[21] Appl. No.: 636,665

[22] Filed: Aug. 1, 1984

[30] Foreign Application Priority Data

Aug. 1, 1983 [JP] Japan ..... 58-141340

[51] Int. Cl.[4] ..... H01P 1/00; H01P 5/08

[52] U.S. Cl. ..... 333/33; 333/260; 339/17 C; 339/222

[58] Field of Search ..... 339/17 C, 222, 223 R; 333/21 R, 33, 260

[56] References Cited

U.S. PATENT DOCUMENTS

| | | | |
|---|---|---|---|
| 2,848,706 | 8/1958 | Besserer | 339/222 |
| 2,898,520 | 8/1959 | Sterner | 339/17 C X |
| 2,983,884 | 5/1961 | Rweger | 333/33 |
| 3,662,318 | 5/1972 | Decuyper | 333/33 X |
| 3,852,690 | 12/1974 | Telfer | 333/33 X |
| 4,186,358 | 1/1980 | Czech et al. | 333/33 |
| 4,507,708 | 3/1985 | Lindberg | 333/260 X |

OTHER PUBLICATIONS

Morton, *Matched Impedance Coaxial Cable Connector*, IBM Technical Disclosure Bulletin, vol. 17, No. 5, Oct. 1974, p. 1335.

*Primary Examiner*—Paul Gensler

*Attorney, Agent, or Firm*—Wenderoth, Lind & Ponack

[57] ABSTRACT

A coaxial line-to-microstrip line transition device including a coaxial line, a microstrip line circuit, and a conductive connection part. The inner conductor of the coaxial line is connected with a microstrip line of the microstrip line circuit. The connection part includes a semi-cylindrical plate which is connected with the outer conductor of the coaxial line by grasping it, and a flat plate which is connected at a surface thereof with a earth layer surface of the microstrip line circuit. The microstrip line is mounted on one surface of a dielectric substrate, and the earth layer is mounted on the other surface of the dielectric substrate. The dielectric substrate is mounted on a chassis which is either provided separately or shared by the flat plate of the connection part which is extended in size. Preferably, a through-hole is provided at least one of the semi-cylindrical plate and the flat plate to be filled with a conductive material.

14 Claims, 12 Drawing Figures

COAXIAL LINE-TO-MICROSTRIP LINE TRANSITION DEVICE

BACKGROUND OF THE INVENTION

1. Field of the Invention

This invention relates to a coaxial line-to-microstrip line transition device for a microwave down-converter used for microwave systems such as satellite broadcasting systems.

2. Description of the Prior Art

Generally, a transmission line used for the microwave device includes as basic elements a wave guide, a coaxial line and, a microstrip line. In a case of connecting different kinds of transmission lines, since the frequency in operation is high, it is important to ensure the earth-connection between the connected lines. Especially the earth-connection between a coaxial line and a microstrip line is difficult due to the completely different line structures. Conventionally, a connector fixed to a package which mounts therein the microstrip line circuit has been used, but it is expensive and unsuitable to mass production.

FIG. 1 is a perspective view of the principal portion of a typical conventional coaxial line-to-microstrip line connector, in which reference numeral 1 designates a coaxial line-to-microstrip line transition connector, reference numeral 2 designates a dielectric substrate provided at the back surface with an earth metal layer 21, reference numeral 3 designates a chassis, reference numeral 4 designates a microstrip line, and reference numeral 5 designate a transistor. On the front surface of dielectric substrate 2 is constituted a microwave circuit comprising the microstrip line 4 and transistor 5 or the like. The dielectric substrate 2 is placed on the chassis 3 so that the earth metal layer 21 is electrically connected with the chassis 3. The inner conductor of the coaxial line-to-microstrip line transition connector 1 and the microstrip line 4 are electrically connected with each other, and the outer conductor of the transition connector 1 is electrically connected with the chassis 3. This conventional coaxial line-to-microstrip line transition connector has good performance with respect to its electrical transition characteristic, but is defective in its high manufacturing cost and unsuitability to mass production.

SUMMARY OF THE INVENTION

An object of the present invention is to provide a coaxial line-to-microstrip line transition device which eliminates the above conventional defects and can achieve a superior earth-connection between a coaxial line and a microstrip line using a simple construction having low manufacturing cost, thereby to realize a superior electrical and mechanical performance.

In order to achieve this object, the present invention provides a transition device which includes a coaxial line having an inner conductor and an outer conductor, a microstrip line to be connected with the inner conductor of the coaxial line and provided on one surface of a dielectric substrate, the other surface of the dielectric substrate being provided thereon with an earth layer, and a conductive connection part having a semi-cylindrical plate to be contacted at its inner surface with the outer conductor of the coaxial line and a flat plate to be contacted at a surface thereof with the earth layer.

It is preferably to provide a through-hole at each of the semi-cylindrical plate and the flat plate, the throughhole being filled with an electrical conductive material to thereby further reinforce the electrical connection.

Furthermore, the flat plate may be extended to a size that is large enough to mount thereon the dielectric substrate so that the flat plate is adapted to be usuable as the chassis for the dielectric substrate.

These constructions according to the invention ensure the mutual earth-connection between the coaxial line and the microstrip line, thereby obtaining a coaxial line-tomicrostrip line transition device inexpensive to produce, superior in high-frequency characteristic, and suitable for mass production.

The above and other objects and features of the invention will be more apparent from the following description with reference to the accompanying drawings.

DETAILED DESCRIPTION OF THE PREFERRED EMBODIMENTS

Next, embodiments of a coaxial line-to-microstrip line transition device of the invention will be described with reference to the drawings.

Figure 1:
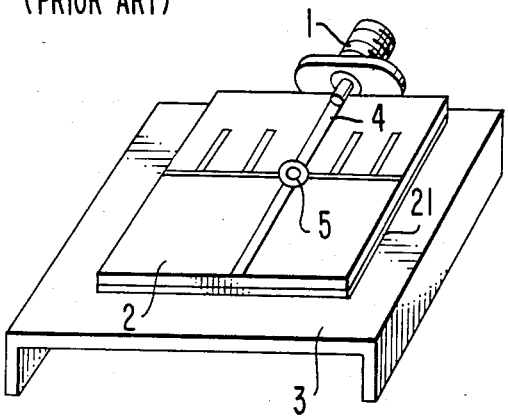
FIG. 1. (PRIOR ART)
FIG. 1 is a perspective view showing a coaxial lineto-microstrip line transition connector in the prior art.
Figure 2:
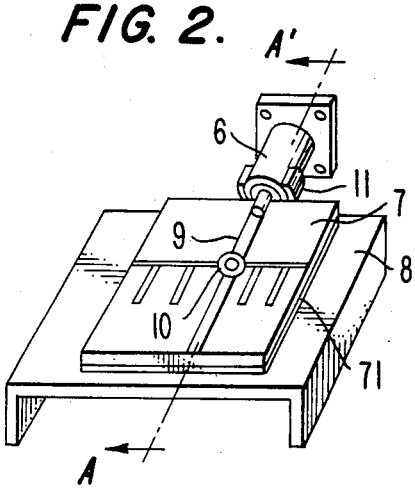
FIG. 2 is a perspective view of a coaxial line-to-microstrip line transition device of the invention.
Figure 3:
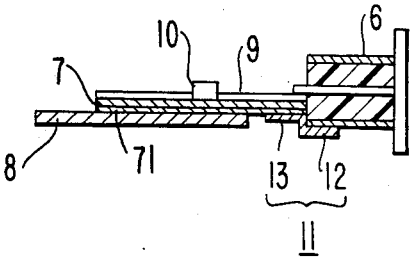
FIG. 3 is a sectional view taken along the line A—A' of FIG. 2.
Figure 4:
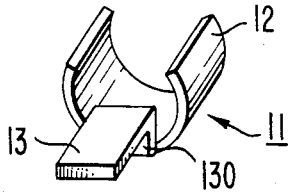
FIG. 4 is a perspective view of an embodiment of a connection part of the invention.

Referring to FIGS. 2 through 4, on the front surface of a dielectric substrate 7 is constituted a microwave circuit comprising a microstrip line 9 and a transistor 10 or the like. The dielectric substrate 7 is mounted on a chassis 8, and a metal layer 71 provided on the back surface of the dielectric substrate 7 is electrically connected with the chassis 8. The inner conductor of a coaxial line 6 is connected electrically with the microstrip line 9 on the dielectric substrate 7. The outer conductor of the coaxial line 6 is in part grasped by a semi-cylindrical plate 12 of a connection part 11, which has an inner diameter the same as the cylindrical outer surface of the outer conductor so as to flush therewith and electrically connected with the same. A part of the metal layer 71 provided at the back surface of the dielectric substrate 7 is electrically connected with a flat plate 13 of the connection part 11.

The connection part 11 comprises the semi-cylindrical plate 12 and the flat plate 13. The plates 12 and 13 may be constructed to be either integral with each other as shown in FIG. 4 or separate and connected by a conductive member 130 with each other. Anyway, the above construction allows easy earth-connection between the cylindrical coaxial line and the metal layer of the microstrip line circuit.

Figure 5:
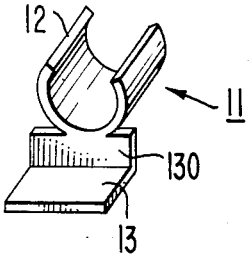
FIG. 5 is a perspective view of another embodiment of a connection part of the invention.

In a case where the coaxial line is smaller in diameter and the positional relation between the back surface of the dielectric substrate 7 and the outer conductor of the coaxial line 6 is reverse to that in FIG. 3, a connection part formed as shown in FIG. 5 can be used. That is, the structure of a part 130 between the flat plate 13 and the semi-cylindrical plate 12 can be modified variously in accordance with the positional relation between the coaxial line and the microstrip line circuit.

Figure 6:
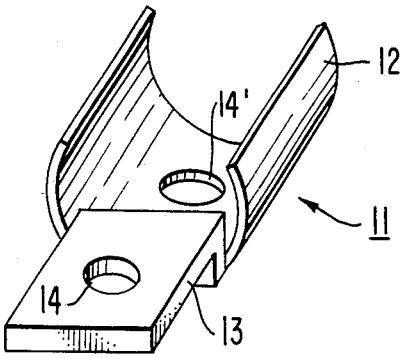
FIG. 6 is a perspective view exemplary of still another embodiment of a connection part of the invention.
Figure 7:
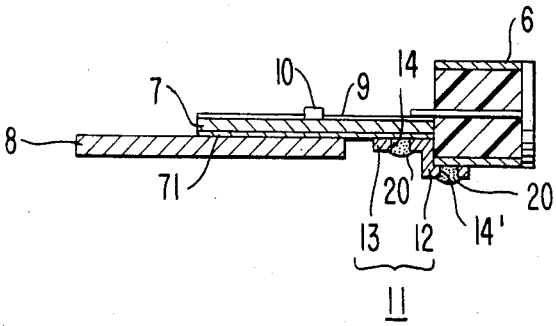
FIG. 7 is a sectional view of an embodiment of a transition device of the invention, which uses the connection part of FIG. 6.

A connection part shown in FIG. 6 has through-holes 14 and 14' at the flat plate 13 and the semi-cylindrical plate 12, respectively. FIG. 7 shows an embodiment using the connection part of FIG. 6, in which the through-holes 14 and 14' are filled with a conductive material 20 such as solder, conductive paint, and silver-alloy brazing, thereby obtaining a further reinforced earth-connection. The two through-holes 14 and 14' may be formed as one elongated through-hole.

Figure 8:
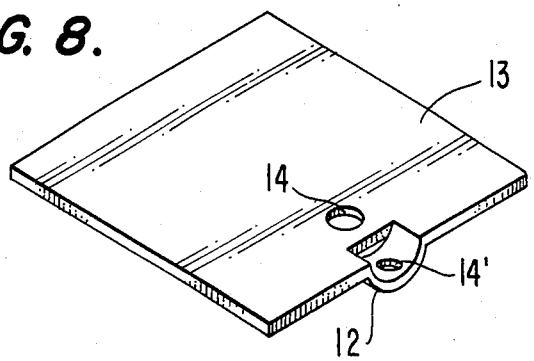
FIG. 8 is a perspective view of a further embodiment of a connection part of the invention.
Figure 9:
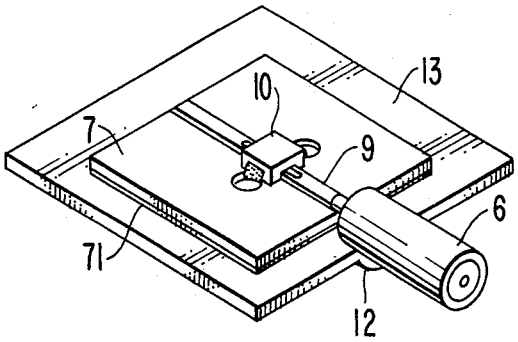
FIG. 9 is a perspective view of an embodiment of a transition device of the invention, which uses the connection part of FIG. 8.

Referring to FIGS. 8 and 9, the flat plate 13 is extended to a size which is large enough to mount thereon the dielectric substrate 7. On the front surface of the substrate 7 are mounted a microwave circuit constructed by such as a microstrip line 9 and a transistor 10. The flat plate 13 of the connection part mounts thereon the dielectric substrate 7 to contact the metal layer provided on the back surface of the dielectric substrate 7. An electrically conductive material is filled in a through-hole 14 provided at the flat plate 13 to enforce the electrical connection between the flat plate 13 and the metal layer on the back surface of the dielectric substrate 7. On the other hand, a coaxial line 6 is fit into the curved plate 12 of the connection part so that the outer cylindrical conductor of the coaxial line 6 contacts the inner surface of the curved plate 12 of the connection part. An electrically conductive material is filled in the through-hole 14' provided at the curved plate 12 to enforce the electrical connection between the curved plate 12 and the outer cylindrical conductor of the coaxial line 6. By this structure, the flat plate of the connection part can be used as the chassis for the microstrip line circuit so that a highly reliable earth-connection between the microstrip line and the coaxial line can be obtained. The connection part as shown in FIG. 8 can be easily produced from a single metal plate by a simple mechanical process. Therefore, the transition device as shown in FIG. 9 has high reliability and high suitability to mass-production.

Figure 10:
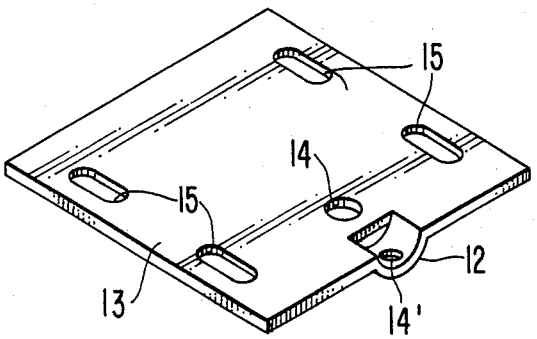
FIG. 10 is a perspective view of a still further embodiment of a connection part of the invention.

Referring to FIG. 10, a connection part is provided at four corners of the flat plate 13 with elongated through-holes 15 which are used for mounting the connection part to a casing for the microwave device. Such elongated through-holes enable positioning between the casing and the connection part, or between the coaxial line and the microstrip line on the dielectric substrate.

Figure 11:
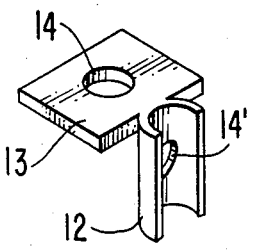
FIG. 11 is a perspective view of yet another embodiment of a connection part of the invention.

Referring to FIG. 11, a connection part has a semi-cylindrical plate 12 which is perpendicular to the surface of the flat plate 13. This structure allows a perpendicular connection that connect a coaxial line and a microstrip line which are perpendicular to each other.

Figure 12:
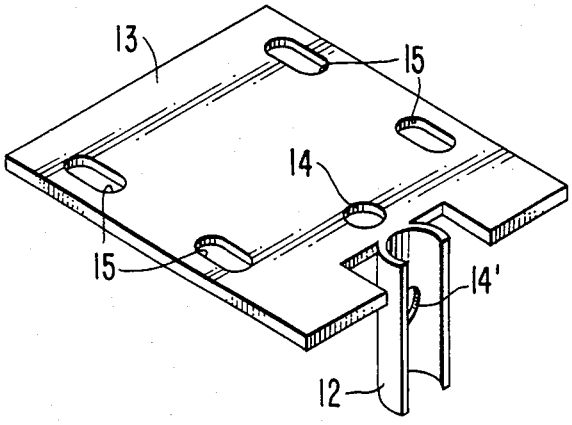
FIG. 12 is a perspective view of a further embodiment of a connection part of the invention.

A connection part shown in FIG. 12 is of the same type as the connection part of perpendicular connection type shown in FIG. 11, but the flat portion 13 is so formed that the dielectric substrate can be placed thereon. Elongated through-holes 15 are provided for mounting the connection part to a casing for the microwave device. This construction has the same advantages as those of the connection part of FIG. 10 with respect to the perpendicular connection of a coaxial line and a microstrip line.

Although several embodiments have been described, they are merely exemplary of the invention, and not intended to limit the scope of the present invention. Various changes and modifications can be made without departing from the scope of the present invention.

What is claimed is:

1. A coaxial line-to-microstrip line transition device, comprising:

a coaxial line having an inner conductor and having an outer conductor having a cylindrical outer surface;

a dielectric substrate having a flat electrically conductive earth layer on one surface thereof;

a microstrip line mounted on a surface of said dielectric substrate opposite said one surface; and conductive connection means for electrically connecting said outer conductor with said earth layer, said means including a semi-cylindrical plate of inner diameter equal to the outer diameter of said outer surface of said outer conductor, in flush contact at its inner surface with said outer surface of said outer conductor, and a flat plate, connected to said semi-cylindrical plate, in flush contact at a flat surface thereof with said earth layer, the axis of said semi-cylindrical plate being generally perpendicular to said surface of said flat plate.

2. The device according to claim 1, wherein said conductive connection means further comprises another plate provided between and electrically connecting said semi-cylindrical plate and said flat plate.

3. The device according to claim 1, wherein said semi-cylindrical plate and said flat plate are made of a single conductive plate.

4. The device according to claim 1, wherein at least one of said semi-cylindrical plate and said flat plate is provided with a through-hole to be filled with a conductive material.

5. The device according to claim 1, further comprising a chassis for mounting thereon said dielectric substrate.

6. A coaxial line-to-microstrip line transition device, comprising:

a coaxial line having an inner conductor and having an outer conductor having a cylindrical outer surface;

a dielectric substrate having a flat electrically conductive earth layer mounted on one surface thereof;

a microstrip line mounted on a surface of said dielectric substrate opposite said one surface; and conductive connection means for electrically connecting said outer conductor with said earth layer, said means including a semi-cylindrical plate of inner diameter equal to the outer diameter of said outer surface of said outer conductor, in flush contact at its inner surface with said outer surface of said outer conductor, and a flat plate mounting on one surface thereof said dielectric substrate such that a part of said one surface of said flat plate is in flush contact with the whole surface of said earth layer mounted on said dielectric substrate.

7. The device according to claim 6, wherein the axis of said semi-cylindrical plate is generally parallel to said flat plate.

8. The device according to claim 7, wherein said semi-cylindrical plate and said flat plate are made of a single conductive plate.

9. The device according to claim 6, wherein the axis of said semi-cylindrical plate is generally perpendicular to said flat plate.

10. The device according to claim 9, wherein said semi-cylindrical plate and said flat plate are made of a single conductive plate.

11. The device according to claim 6, wherein at least one of said semi-cylindrical plate and said flat plate is provided with a through-hole to be filled with a conductive material.

12. The device according to claim 6, wherein said flat plate is provided with elongated through-holes for mounting therethrough said device to a case.

13. A coaxial line-to-microstrip line transition device, comprising:

a coaxial line having an inner conductor and having an outer conductor having a cylindrical outer surface;

a dielectric substrate having a flat electrically conductive earth layer on one surface thereof;

a microstrip line mounted on a surface of said dielectric substrate opposite said one surface; and conductive connection means for electrically connecting said outer conductor with said earth layer, said means comprising a single conductive plate including a semi-cylindrical plate portion of inner diameter equal to the outer diameter of said outer surface of said outer conductor, in flush contact at its inner surface with said outer surface of said outer conductor, and a flat plate portion connected to said semi-cylindrical plate portion, mounting on one surface thereof said dielectric substrate such that a part of said one surface of said flat plate is in flush contact with the whole surface of said earth layer mounted on said dielectric substrate, the axis of said semi-cylindrical plate portion being generally parallel to said flat plate portion, and at least one of said semi-cylindrical and flat plate portions being provided with a through-hole for being filled with a conductive material.

14. The device according to claim 13, wherein said flat plate portion is provided at corners thereof elongated through-holes through which said device is mountable to a case.

* * * * *